US008342141B2

(12) United States Patent
Dahl et al.

(10) Patent No.: US 8,342,141 B2
(45) Date of Patent: Jan. 1, 2013

(54) ENGINE COOLING SYSTEM

(75) Inventors: Erik Dahl, Göteborg (SE); Steven Adelman, Göteborg (SE)

(73) Assignee: Volvo Lastvagnar AB, Göteborg (SE)

( * ) Notice: Subject to any disclaimer, the term of this patent is extended or adjusted under 35 U.S.C. 154(b) by 731 days.

(21) Appl. No.: 12/446,239

(22) PCT Filed: Oct. 16, 2007

(86) PCT No.: PCT/SE2007/000908

§ 371 (c)(1),
(2), (4) Date: Aug. 10, 2009

(87) PCT Pub. No.: WO2008/048166

PCT Pub. Date: Apr. 24, 2008

(65) Prior Publication Data

US 2009/0301409 A1 Dec. 10, 2009

(51) Int. Cl.
*F01P 7/14* (2006.01)

(52) U.S. Cl. ..... 123/41.1; 123/41.13

(58) Field of Classification Search ..... 123/41.08–41.1, 123/41.13

See application file for complete search history.

(56) References Cited

U.S. PATENT DOCUMENTS 5,215,044 A * 6/1993 Banzhaf et al. ..... 123/41.1
5,799,625 A 9/1998 Ziolek et al.
2004/0065275 A1 4/2004 Hayami et al.

FOREIGN PATENT DOCUMENTS

WO 9608640 A1 3/1996

OTHER PUBLICATIONS

International Search Report from corresponding International Application PCT/SE2007/000908.

* cited by examiner

*Primary Examiner* — Noah Kamen
(74) *Attorney, Agent, or Firm* — WRB-IP LLP

(57) ABSTRACT

An engine cooling system in which a coolant flows through a coolant circuit includes: a pump for circulating coolant under pressure through the coolant circuit; a radiator provided in the coolant circuit, wherein the radiator cools coolant passing through the coolant circuit; a by-pass conduit, wherein the by-pass conduit allows coolant to by-pass the radiator, a flow control valve, which regulates the flow rate of coolant flowing through the radiator and the by-pass conduit; and a controller, wherein the controller controls the flow control valve in response to input signals from at least one pressure sensor and at least one temperature sensor in the coolant circuit. The flow control valve includes a first controllable valve located upstream of the radiator and downstream of the by-pass conduit, and a second controllable valve located in the by-pass conduit.

10 Claims, 2 Drawing Sheets

ENGINE COOLING SYSTEM

BACKGROUND AND SUMMARY

The invention relates to an engine cooling system provided with means for controlling the pressure in different sections of the cooling system during different engine operating modes. This allows one section to be pressurized during a cold start to avoid cavitation, while another circuit can be protected from excessive pressure when the engine is operated at high speed.

Due to a number of factors, such as stricter emission standards and more accessories requiring cooling, the demand for cooling of engine components and accessories is continuously increasing. Consequently, future vehicle engines, in particular truck engines, will require a higher coolant flow compared to current production engines to cope with the increased demand. Increasing the flow of coolant may, however, cause a number of problems.

An increase of the coolant flow through a radiator may result in a larger pressure drop across the radiator than the current design can withstand. The coolant flow may become high enough to cause internal erosion inside the radiator core. An increased coolant flow will normally improve the heat rejection, or cooling capacity, of the radiator, but the coolant flows in current radiators are often so high that the radiators are already saturated on the coolant side. Hence, an additional increase in coolant flow may only give a very slight increase in heat rejection.

Additional problems relating to cooling of vehicle engines involves the risk of cavitation in the engine block and the failure of engine heat exchangers such as EGR-coolers due to the effect of the coolant boiling in local hot-spots. The above problems may at least partially be avoided by increasing the pressure in the engine cooling system. The maximum pressure that can be used in the cooling system is limited by the design pressure of the radiator.

A conventional solution involves using a closed cooling system with an expansion tank and a pressure relief valve. During operation of the engine the coolant is heated up and the engine coolant volume increases to a predetermined level. Pressure variations may be controlled by the expansion tank. If the system becomes overheated the pressure in the cooling system increases up to a maximum allowed pressure and the pressure relief valve is opened for venting excess pressure to the atmosphere.

One problem with an engine cooling system of this type is that the increased system pressure adds to the pressure drop over radiator. The total pressure drop may therefore become too high for the radiator resulting in coolant leaks or even burst coolant conduits or tubes. On the other hand, there is no or a very low pressure in the cooling system during a cold start when the engine temperature is relatively low. Hence, a local build-up of heat in the engine may cause cavitation to occur in coolant conduits in the engine during a cold start before the cooling system pressure builds up.

The problem of lack of pressure in the cooling system during start-up can be solved by pressurizing the system with air from air-brake system. In this way pressurized air can be supplied to the expansion tank, or similar, to achieve a pressure increase at once when the engine is started. However, this solution will not solve the problem relating to a large pressure drop over the radiator.

In order to protect the radiator from excessive pressures, a pressure sensitive by-pass valve can be installed. This will limit the pressure drop over the radiator to an acceptable level and direct at least a part of the coolant flow into a by-pass conduit connected between the valve and a conduit downstream of the radiator. However, the use of this type of valve will require a relatively long time for pressurizing the cooling system during a cold start.

The above problems relating to cavitation in the engine caused during a cold start and coolant flows causing an excessive drop across a radiator are solved by an improved cooling system according to the invention.

According to a preferred embodiment, the invention relates to an engine cooling system comprising a coolant circuit extending through an engine, wherein a coolant flows through the coolant circuit. The engine is preferably a vehicle engine, but the invention can also be used for marine engines or stationary engines. A pump is provided for circulating coolant under pressure through the coolant circuit and a radiator is provided for cooling coolant passing through the coolant circuit. The pump is preferably, but not necessarily, a centrifugal pump. The coolant circuit further comprises a bypass conduit, wherein the by-pass conduit allows coolant to bypass the radiator and return to the pump. A flow control valve means is arranged for regulating the flow rate of coolant flowing through the radiator and the by-pass conduit and a controller is provided for controlling the flow control valve means in response to input signals from at least one pressure sensor and at least one temperature sensor in the coolant circuit. The controller may be a separate electronic control unit (ECU), connected to at least the said sensors, or a main ECU for controlling the engine operation, connected to these and additional sensors for monitoring all relevant engine related parameters. The flow control valve means may comprise a first controllable valve located in the coolant circuit upstream of the radiator and downstream of the by-pass conduit. A second controllable valve may be located in the bypass conduit.

The first and second individually controllable valves may be analogue valves that can be controlled steplessly between a closed and an open position. An example of valves suitable for this purpose may be electrically or solenoid operated one-way valves. The valves may be arranged to take up any position between fully open and completely closed. Normal operation is preferably, but not necessarily that one valve opens while the other closes.

During a first mode of operation the first and second controllable valves are controlled simultaneously, wherein the total flow through the valves is equal to the flow delivered by the pump. By throttling the valves, the pressure across the pump increases in order to pressurize the system. This mode is in operation after a cold start of the engine, when the pressure in the coolant system is relatively low and the temperature is near the ambient temperature. The first mode of operation is used in order to achieve a relatively rapid pressurization of the section of the coolant circuit that passes through the engine. This mode is typically in operation immediately after a cold start of the engine.

Initially during the cold start mode both the first and second valves will be closed. A limited, controlled leakage through the bypass circuit may be permitted during the initial stage of the pressurization to avoid surge in the pump. The pump is located upstream of the engine and will deliver a relatively high pressure, as there is no or very little flow. A suitable pump for this purpose is preferably, but not necessarily, a centrifugal pump, which is often used in the coolant circuit of truck engines or similar. The coolant will initially be relatively cold and the system pressure in an expansion tank connected to the coolant circuit will be relatively low.

The controller may maintain the first controllable valve in a closed position and controls the second controllable valve in response to the input from a pressure sensor in the coolant circuit downstream of the engine. The second controllable valve may be controlled to maintain a predetermined minimum pressure in the coolant circuit through the engine. Once a desired pressure has been established In the part of the cooling circuit comprising the engine and the by-pass conduit, the controller may control the first controllable valve and/or the second controllable valve in response to the input from a temperature sensor in the coolant circuit downstream of the engine.

The controller may also control the first and second controllable valves in response to the input from a temperature sensor that is preferably, but not necessarily, located in the coolant circuit immediately downstream of the pump. The temperature sensor may alternatively be located in a suitable location between the radiator and the pump. If relatively cold coolant from the initially closed circuit containing the radiator enters parts of the coolant circuit containing the engine block with its cylinder liners, an optional EGR-cooler and similar relatively hot components, then the hot components may experience a thermal shock. If the temperature sensor downstream of the pump senses that the coolant from the radiator is below a predetermined limit, then the flow trough the first valve will be reduced and the flow through the second valve will be increased a corresponding amount. This control of the first valve also prevents relatively hot coolant from the engine from causing a thermal shock in the part of the cooling system containing the relatively cold radiator. The temperature is monitored until the radiator has reached a nominal operating temperature.

In this way components such as cylinder liners, EGR-coolers and similar will by supplied with coolant at a relatively high pressure (system pressure plus pump pressure) immediately after start. This prevents a local build-up of heat from causing cavitation adjacent the cylinder liners in the engine block and other parts of the pressurized coolant conduits of the engine.

During a second mode of operation the first and second controllable valves are controlled simultaneously or substantially simultaneously, wherein the total flow through the valves is equal to or substantially equals the flow delivered by the pump. The second mode of operation is used in order to control the pressure in the section of the coolant circuit that passes through the radiator. During periods where the engine is operated under a high load and/or a high engine speeds it is desirable to increase the cooling capacity of the cooling system. The coolant flow and pressure delivered by a fixed displacement pump driven by the engine is dependent on the engine speed. Hence a relatively high engine speed will result in a relatively high coolant flow and an increased system pressure.

Alternatively an increase in the coolant flow may be achieved by increasing the speed of an electrically driven pump or controlling a variable displacement pump, which increases both the coolant flow and the pressure in the cooling system.

An increased system pressure adds to the pressure drop over the radiator and it is therefore desirable to control the pressure of the coolant entering the radiator inlet. The controller will monitor at least the pressure and temperature of the coolant downstream of the engine and the pressure at the inlet of the radiator. The latter pressure is sensed by a second pressure sensor, located between the first valve and the radiator inlet. When the pressure at the radiator inlet approaches a maximum allowable value the radiator will be near its maximum cooling capacity. At this point the radiator is almost saturated on the coolant side an increase in the coolant flow through the radiator will only have a minor effect on the heat rejection to the atmosphere. As long as the radiator inlet pressure, and hence the total pressure drop over the radiator, is less than or equal to a predetermined maximum value the first controllable valve will be nearly fully open and the second controllable valve will be partially open. However, should the inlet pressure exceed this value, the controller will control the first controllable valve to limit the coolant pressure in the radiator to a predetermined maximum value.

BRIEF DESCRIPTION OF DRAWINGS

In the following text, the invention will be described in detail with reference to the attached drawings. These schematic drawings are used for illustration only and do not in any way limit the scope of the invention. In the drawings.

DETAILED DESCRIPTION

Figure 1:
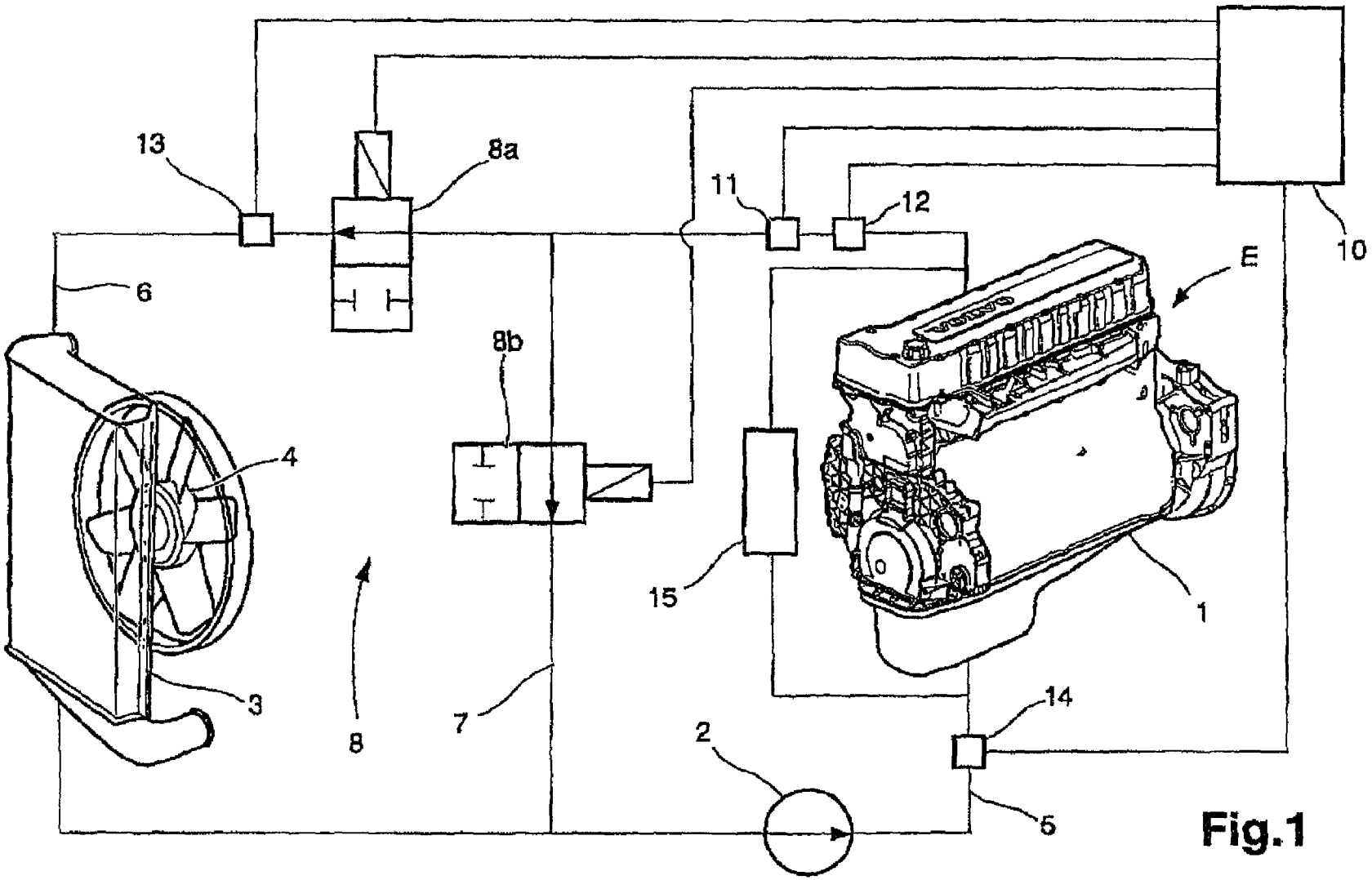
FIG. 1 shows a schematic illustration of an engine cooling system according to a first embodiment of the invention.

FIG. 1 describes an engine cooling system comprising a coolant circuit extending through an engine block 1 of an engine E, wherein a coolant such as water flows through the coolant circuit. A centrifugal pump 2 is provided for circulating coolant under pressure through the coolant circuit and a radiator 3 is provided for cooling coolant passing through the coolant circuit. A driven fan 4 is mounted adjacent the radiator 3 to control the flow of ambient air through the radiator. The coolant circuit further comprises a first section 5 comprising the engine block 1 and the pump 2 and a second section 6 comprising the radiator 3. The coolant circuit further comprises a by-pass conduit 7, wherein the by-pass conduit 4 allows coolant to by-pass the radiator 3.

A flow control valve means 8 is arranged for regulating the flow rate of coolant flowing through the radiator 3 and the by-pass conduit 7, respectively. The flow control valve means 8 comprises a first controllable valve 8*a* located in the first coolant circuit 6 upstream of the radiator 3 and downstream of the by-pass conduit 7. A second controllable valve 8*b* is located in the by-pass conduit 7. The controllable valves are electrically controlled solenoid valves which can be controlled steplessly from a closed to an open position. A controller 10 is provided for controlling the first and second controllable valves 8*a*, 8*b* in response to input signals from the pressure and/or temperature sensors In the coolant circuit. The controller 10 is an electronic control unit connected to the said sensors and to the solenoids controlling the first and second valves. A first pressure sensor 11 is located in the first coolant circuit 5 downstream of the engine E. A first temperature sensor 12 is located in the first coolant circuit 5 adjacent the first pressure sensor 11 downstream of the engine. A second pressure sensor 13, located in the second coolant circuit 6 between the first controllable valve 8*a* and the inlet of the radiator 3. A second temperature sensor 14 is located in the first coolant circuit 5 immediately downstream of the pump 2.

The cooling system can optionally be provided with additional components, such as a cooler 15 for recirculated exhaust gas (EGR). The EGR cooler can be provided with separate means for controlling flow and pressure (not shown). However, these means are not relevant for the invention and will not be described in further detail.

The cooling system in FIG. 1 can be operated in at least two different modes, wherein a first and a second mode will be described below.

During a first mode of operation the first and second controllable valves 8*a*, 8*b* are controlled so that the total flow through the valves is equal to the flow delivered by the pump 2. This mode Is in operation after a cold start of the engine, when the pressure in the coolant system is relatively low and the temperature is near the ambient temperature. When the engine is started, the controller will receive output signals from the first pressure sensor 11 and the first temperature sensor 12. If the sensed values for pressure and temperature are below a predetermined limit, then it is determined that a cold start mode is required. The cold start mode is used In order to achieve a rapid pressurization of the first section 5 of the coolant circuit that passes through the engine E.

During the cold start mode both the controller 10 will initially actuate the first and second valves 8 at 8*b* and close both valves. A limited, controlled leakage through the bypass circuit 7 may be permitted during the initial stage of the pressurization to avoid surge in the pump 2. The pump 2 is located upstream of the engine E and will deliver a relatively high pressure, as there is no or very little flow through the circuits at this time. The coolant will initially be relatively cold and the system pressure in the coolant circuits 5, β, 7 and in an expansion tank (not shown) connected to the coolant circuits will be relatively low.

The controller 10 maintains the first controllable valve 8*a* in a closed position and controls the second controllable valve 8*b* in response to the input from the first pressure sensor 11 in the first coolant circuit 5 downstream of the engine E. In the cold start mode the second controllable valve 8*b* may be controlled to increase and subsequently maintain a predetermined minimum pressure in the first coolant circuit 5 through the engine E. Once a desired pressure has been established in the part of the cooling circuit comprising the engine and the by-pass conduit 7 upstream of the second controllable valve 8*b*, the controller can start to open the first controllable valve 8*a* and/or the second controllable valve 8*b* in response to the input from the first temperature sensor 12 in the first coolant circuit 5 downstream of the engine.

When the first cooling circuit 5 has been pressurized, the controller 10 will control the first and second controllable valves 8*a*, 8*b* in response to the input from the second temperature sensor located in the coolant circuit immediately downstream of the pump 2. If relatively cold coolant from the Initially closed second circuit 6, containing the radiator, enters parts of the first coolant circuit 5 containing the engine block with its cylinder liners, an optional EGR-cooler and similar relatively hot components, then the hot components may experience a thermal shock. Hence, if the second temperature sensor 14 downstream of the pump 2 senses that the coolant from the radiator 3 is below a predetermined limit, then the flow trough the first controllable valve 8*a* will be reduced and the flow through the second controllable valve 8*b* will be increased a corresponding amount. This control of the first controllable valve 8*a* also prevents relatively hot coolant from the first cooling circuit 5 from causing a thermal shock in the second cooling circuit 6 containing the relatively cold radiator 3. The controller 10 will monitor the temperatures in the first cooling circuit 5 until the radiator 3 has reached a nominal operating temperature. It has been assumed that the fan 4 is not operated in the cold start mode due to the relatively low temperature in the cooling system.

In this way components such as the engine block, the cylinder liners, EGR-coolers and similar components will by supplied with coolant at a relatively high pressure (system pressure plus pump pressure) immediately after a cold start. This prevents a local build-up of heat from causing cavitation adjacent the cylinder liners in the engine block and other parts of the pressurized coolant conduits of the engine.

During the second mode of operation the first and second controllable valves 8*a*, 8*b* are controlled simultaneously, wherein the total flow through the valves equals the flow delivered by the pump 2. The second mode of operation is used in order to control the pressure in the second section 6 of the coolant circuit that passes through the radiator 3. During periods where the engine E is operated under a high load and/or a high engine speed it is desirable to increase the cooling capacity of the cooling system. In the example shown in FIG. 1, the pump 2 driven by the engine and the coolant flow and pressure delivered is dependent on the engine speed n. Hence a relatively high engine speed n will result in a relatively high coolant flow q and an increased system pressure P.

Figure 2:
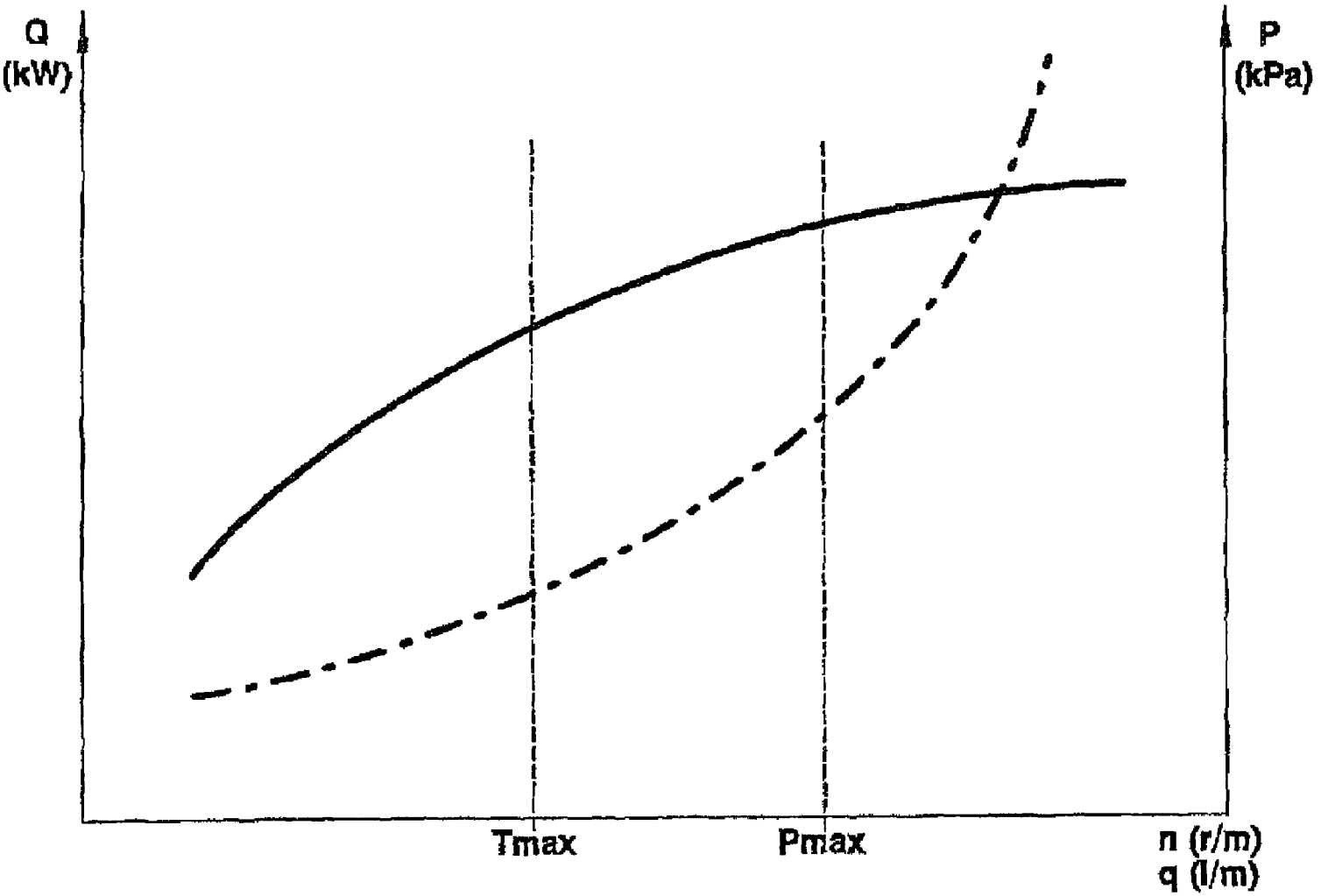
FIG. 2 shows a schematic diagram of heat rejection plotted over coolant flow and pressure drop over the radiator plotted over engine speed.

An increased system pressure P adds to the pressure drop δP over the radiator and it is therefore desirable to control the pressure of the coolant entering the radiator inlet. The controller 10 will monitor the pressure and temperature sensors 11, 12 in the first cooling circuit downstream of the engine and the pressure sensor 13 upstream of the radiator 3 between the first controllable valve 8*a* and the radiator inlet. When the pressure at the radiator inlet approaches a maximum allowable value the radiator will be near its maximum cooling capacity. At this point the radiator is almost saturated on the coolant side an increase in the coolant flow through the radiator will only have a minor effect on the heat Q rejected to the atmosphere. This is illustrated in FIG. 2, which shows a schematic diagram of heat rejection Q (kW) plotted over coolant flow q (l/min) and pressure drop δP (kPa) over the radiator plotted over engine speed n (rpm). The upper curve shows how the heat rejection Q of the radiator increases with coolant flow q. However, at higher coolant flows q the rate of Increase in heat rejection Q diminishes with an increased coolant flow. Similarly, the lower curve shows how the pressure drop P over the radiator increases sharply with increasing engine speed n. Consequently, the heat rejection Q from the radiator can be maintained at a level near its maximum even if the pressure drop across the radiator is limited to a predetermined value. As long as the radiator inlet pressure, and hence the total pressure drop over the radiator, is less than or equal to a predetermined maximum value the first controllable valve 8*a* will be nearly fully open and the second controllable valve 8*b* will be partially open. It is assumed that the fan 4 is operating at maximum capacity at this stage. Should the inlet pressure exceed the maximum value, the controller 10 will first control begin to open the second controllable valve 8*b* to reduce the pressure drop over the radiator 3. The first controllable valve 8*a* will be kept open to maintain the heat rejection Q to the atmosphere as high as possible. During an extended high load period the pressure in the second cooling circuit 6 may continue to increase even when the second controllable valve 8*b* is fully open. In this case, the controller 10 will begin to close the first controllable valve 8*a* to limit the coolant pressure in the radiator to a predetermined maximum value to prevent damage to the radiator. At this stage the operator should be given a notification to the effect that the engine load should be reduced to avoid overheating.

The invention is not limited to the embodiments described above, but may be varied freely within the scope of the claims. For instance, the above example describes a non-limiting example where a pump is driven by the engine. Alternatively an increase in the coolant flow may be achieved by increasing the speed of an electrically driven pump or by controlling a variable displacement pump, which increases both the coolant flow and the pressure in the cooling system.

The invention claimed is:

1. An engine cooling system, comprising a coolant circuit extending through an engine, wherein a coolant flows through the coolant circuit; a pump for circulating coolant under pressure through the coolant circuit; a radiator provided in the coolant circuit, wherein the radiator cools coolant passing through the coolant circuit; a by-pass conduit, wherein the by-pass conduit allows coolant to by-pass the radiator, a flow control valve, which regulates the flow rate of coolant flowing through the radiator and the by-pass conduit; and a controller, wherein the controller controls the flow control valve in response to input signals from at least one pressure sensor and at least one temperature sensor in the coolant circuit, wherein the flow control valve comprises a first controllable valve located upstream of the radiator and downstream of the by-pass conduit, and a second controllable valve located in the by-pass conduit, wherein, during, a first mode of operation the first and second controllable valves are controlled simultaneously, wherein the valves are arranged to be throttled to increase the pressure delivered by the pump.

2. Engine cooling system according to claim 1, wherein the controller maintains the first controllable valve in a closed position and controls the second controllable valve in response to the input from a pressure sensor in the coolant circuit downstream of the engine.

3. Engine cooling system according to claim 2, wherein the controller controls the second controllable valve to maintain a predetermined minimum pressure in the coolant circuit through the engine.

4. Engine cooling system according to claim 3, wherein the controller controls the first controllable valve in response to the input from a temperature sensor in the coolant circuit downstream of the engine.

5. Engine cooling system according to claim 4, wherein the controller controls the first controllable valve in response to the input from a temperature sensor in the coolant circuit downstream of the pump.

6. Engine cooling system according to claim 1, wherein the first mode of operation is a cold start of the engine.

7. Engine cooling system according to claim 1, wherein the engine is operated under a high load in the first mode of operation.

8. An engine cooling system, comprising a coolant circuit extending through an engine, wherein a coolant flows through the coolant circuit; a pump for circulating coolant under pressure through the coolant circuit; a radiator provided in the coolant circuit, wherein the radiator cools coolant passing through the coolant circuit; a by-pass conduit, wherein the by-pass conduit allows coolant to by-pass the radiator, a flow control valve, which regulates the flow rate of coolant flowing through the radiator and the by-pass conduit; and a controller, wherein the controller controls the flow control valve in response to input signals from at least one pressure sensor and at least one temperature sensor in the coolant circuit, wherein the flow control valve comprises a first controllable valve located upstream of the radiator and downstream of the by-pass conduit, and a second controllable valve located in the by-pass conduit, wherein the first and second controllable valves are controlled simultaneously, the total flow through the valves equals the flow delivered by the pump, and the controller maintains the first controllable valve in an open position and maintains the second controllable valve in an open position when the pressure in the radiator is less than or equal to a predetermined value.

9. Engine cooling system according to claim 8, wherein the controller controls the first controllable valve in response to the input from a pressure sensor in the coolant circuit between the first valve and the radiator.

10. Engine cooling system according to claim 9, wherein the controller controls the first controllable valve to limit the coolant pressure in the radiator to a predetermined maximum value.

* * * * *